US007766455B2

(12) United States Patent
Graham et al.

(10) Patent No.: US 7,766,455 B2
(45) Date of Patent: Aug. 3, 2010

(54) FLEXIBLE ADHESIVE MATERIALS FOR MICRO-FLUID EJECTION HEADS AND METHODS RELATING THERETO

(75) Inventors: David Christopher Graham, Lexington, KY (US); Brian Christopher Hart, Madison, WI (US); Gary Anthony Holt, Jr., Lexington, KY (US); John William Krawczyk, Richmond, KY (US); Sean Terrence Weaver, Union, KY (US); Mary Claire Smoot, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 943 days.

(21) Appl. No.: 11/556,246

(22) Filed: Nov. 3, 2006

(65) Prior Publication Data

US 2007/0229594 A1 Oct. 4, 2007

Related U.S. Application Data

(60) Provisional application No. 60/826,490, filed on Sep. 21, 2006, provisional application No. 60/743,920, filed on Mar. 29, 2006.

(51) Int. Cl.
*B41J 2/14* (2006.01)
*B41J 2/16* (2006.01)

(52) U.S. Cl. ..... 347/47; 347/64

(58) Field of Classification Search ..... 347/44–47, 347/63, 64

See application file for complete search history.

(56) References Cited

U.S. PATENT DOCUMENTS

| | | | | |
|---|---|---|---|---|
| 5,258,781 | A * | 11/1993 | John | 347/63 |
| 5,710,584 | A | 1/1998 | Suzuki et al. | |
| 6,188,414 | B1 * | 2/2001 | Wong et al. | 347/42 |
| 6,325,491 | B1 | 12/2001 | Feinn | |
| 6,328,427 | B1 * | 12/2001 | Watanabe et al. | 347/58 |
| 6,361,160 | B2 | 3/2002 | Feinn et al. | |
| 6,364,475 | B2 | 4/2002 | Feinn et al. | |
| 6,494,566 | B1 * | 12/2002 | Kishino et al. | 347/70 |
| 6,554,399 | B2 | 4/2003 | Wong et al. | |
| 6,747,346 | B2 | 6/2004 | Sato et al. | |
| 6,902,260 | B2 | 6/2005 | Aschoff et al. | |
| 2005/0036010 | A1 | 2/2005 | Terakura et al. | |
| 2005/0036012 | A1 | 2/2005 | Terakura | |

* cited by examiner

*Primary Examiner*—Thinh H Nguyen

(57) ABSTRACT

Micro-fluid ejection head structures, methods of making micro-fluid ejection head structures having improved operability, and methods for improving the durability of micro-fluid ejection head structures are provided. One such micro-fluid ejection head structure includes a micro-fluid ejection head having a substrate and nozzle plate assembly adhesively attached adjacent to a substrate support using a substrate adhesive. The nozzle plate is adhesively attached adjacent to the substrate with a nozzle plate adhesive. A thermally, UV or other cure mechanism encapsulant material is attached adjacent to the ejection head and substrate support. Each of the substrate adhesive, and the encapsulant material, after curing, have a Young's modulus of less than about 2000 MPa, a shear modulus at 25° C. of less than about 15 MPa, and a glass transition temperature of less than about 90° C.

17 Claims, 10 Drawing Sheets

FIG. 2
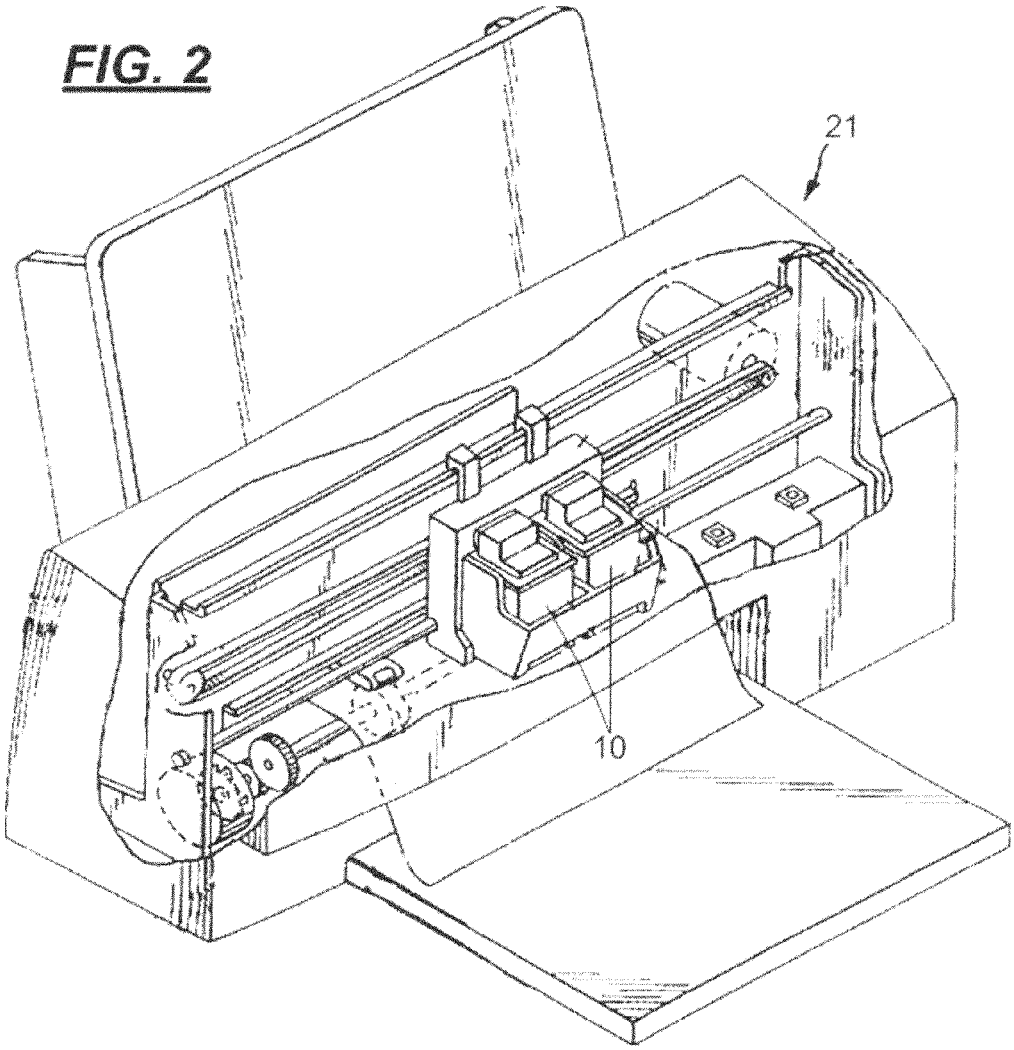
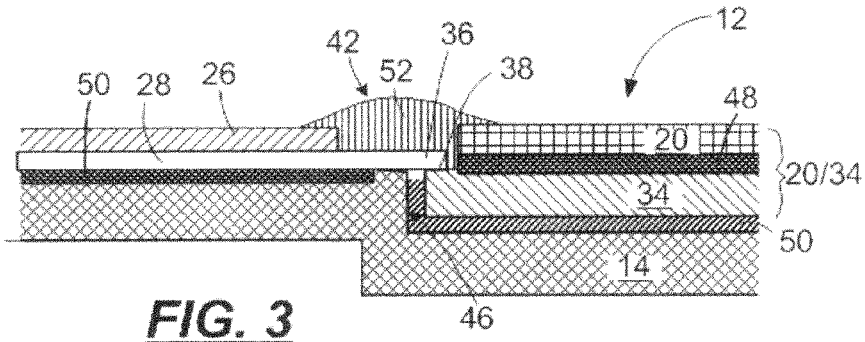
FIG. 3

FLEXIBLE ADHESIVE MATERIALS FOR MICRO-FLUID EJECTION HEADS AND METHODS RELATING THERETO

RELATED APPLICATIONS

This application claims the benefit of provisional application Ser. No. 60/743,920, filed Mar. 29, 2006.

TECHNICAL FIELD

The disclosure relates to adhesives, and in one particular embodiment, to flexible adhesives that may be used for bonding and sealing components of micro-fluid ejection heads.

BACKGROUND AND SUMMARY

Micro-fluid ejection heads are useful for ejecting a variety of fluids including inks, cooling fluids, pharmaceuticals, lubricants and the like. A widely used micro-fluid ejection head is an inkjet print head used in an ink jet printer. Ink jet printers continue to be improved as the technology for making their micro-fluid ejection heads continues to advance.

In the production of conventional thermal ink jet print cartridges for use in ink jet printers, one or more micro-fluid ejection heads are typically bonded to one or more chip pockets of an ejection device structure. A micro-fluid ejection head typically includes a fluid-receiving opening and fluid supply channels through which fluid travels to a plurality of bubble chambers. Each bubble chamber includes an actuator such as a resistor which, in the case of a resistor, when addressed with an energy pulse, momentarily vaporizes the fluid and forms a bubble which expels a fluid droplet. The micro-fluid ejection head is provided by an ejector chip and a nozzle plate having a plurality of discharge orifices formed therein attached to the chip. The chip and nozzle plate assembly are adhesively attached to an ejection device structure that provides fluid flow to the ejection head.

A container, which may be integral with, detachable from or remotely connected to (such as by tubing) the ejection device structure, serves as a reservoir for the fluid and includes a fluid supply opening that communicates with a fluid-receiving opening of a micro-fluid ejection head for supplying ink to the bubble chambers in the micro-fluid ejection head.

During assembly of the micro-fluid ejection head to the ejection device structure, an adhesive is used to bond the ejection head to the ejection device structure. The adhesive "fixes" the micro-fluid ejection head to the ejection device structure such that its location relative to the ejection device structure is substantially immovable and does not shift during processing or use of the ejection head. The bonding and fixing step is often referred to as a "die attach step". Further, the adhesive may provide additional functions such as serving as a fluid gasket against leakage of fluid and as corrosion protection for conductive tracing. The latter function for the adhesive is referred to as part of the adhesive's encapsulating function, thereby further defining the adhesive as an "encapsulant" to protect electrical component connections, such as a flexible circuit (e.g., a TAB circuit) attached to the micro-fluid ejection head, from corrosion.

However, the micro-fluid ejection head and the ejection device structure typically have dissimilar coefficients of thermal expansion. For example, micro-fluid ejection heads may have silicon or ceramic substrates that are bonded to an ejection device structure that may be a polymeric material such as a modified phenylene oxide. Thus, the substrate adhesive (e.g., die bond), nozzle plate adhesive, and encapsulant must accommodate both dissimilar expansions and contractions of the micro-fluid ejection head and the ejection device structure, and be resistant to attack by the ejected fluid.

Conventional adhesive and encapsulant materials tend to be non-flexible and brittle after curing due to high temperatures required for curing and relatively high shear modulus of the adhesive materials upon curing. Such properties may cause the adhesive or encapsulant materials to chip or crack. It may also cause the components (e.g., micro-fluid ejection head and/or ejection device structure) to bow, chip, crack, or otherwise separate from one another, or to be less resilient to external forces (e.g., chips may be more prone to crack when dropped). For example, during a conventional thermal curing process, the ejection device structure typically expands before a conventional substrate adhesive and encapsulant material are fully cured. The adhesive and encapsulant materials thus move with the expanding device structure, wherein the adhesive and encapsulant materials cure with the device structure in an expanded state. Upon cooling the device structure, the device structure contracts and, with rigid, cured adhesives or rigid, cured encapsulant materials, high stress may be induced onto the ejection head structure to cause the aforementioned bowing, chipping, cracking, separating, etc.

Such adverse effects as bowing, chipping, cracking, separating, etc., may be even more pronounced as the substrates for the device structure are made thinner. Among other problems, such events may result in fluid leakage, corrosion of electrical component, and poor adhesion as well as malfunctioning of the micro-fluid ejection heads, such as misdirected nozzles. Moreover, attempts to make adhesive materials and encapsulant materials more flexible after curing often lead to materials that are less resistant to chemical degradation by the fluids being ejected.

Accordingly, a need exists for, amongst other things, micro-fluid ejection heads containing adhesive and encapsulant materials that are effective to reduce bowing or warping of ejection heads, and to improve the resistance of the ejection heads to corrosion of electrical components and impact damage due to dropping or other mishandling of the ejection heads.

With regard to the foregoing and other object and advantages, various embodiments of the disclosure provide a micro-fluid ejection head structure, methods of making micro-fluid ejection head structures having improved operability, and methods for improving the durability of micro-fluid ejection head structures. An exemplary micro-fluid ejection head structure includes a micro-fluid ejection head having a substrate and nozzle plate adhesively attached adjacent to a substrate support using a substrate adhesive, such as a die bond adhesive. The nozzle plate is adhesively attached adjacent to the substrate with a nozzle plate adhesive. An encapsulant material is adjacent to the ejection head and substrate support structure. The cure method for this material could utilize, for example, one or more of the following cure mechanisms: thermal cure, photosensitive cure, microwave cure, infrared (IR) cure, moisture cure, room temperature cure, actinic radiation cure (visible light, ultraviolet (UV) light, electron beam, x-ray, gamma-ray, beta-ray and the like), or multi- or dual-cure systems such as UV-initiated and thermal completed cure mechanisms. Each of the substrate adhesive and the encapsulant material, after curing, have a Young's modulus of less than about 2000 MPa, a shear modulus at 25° C. of less than about 15 MPa, and a glass transition temperature of less than about 90° C.

Additional embodiments provide a method for reducing bowing or warping of a micro-fluid ejection head component.

According to one such method, a nozzle plate is adhesively bonded adjacent to a substrate with a nozzle plate adhesive to provide a nozzle plate/substrate assembly. The nozzle plate/substrate assembly is adhesively bonded in a pocket of a substrate support using a substrate adhesive. Electrical connections to the nozzle plate/substrate assembly are encapsulated with an encapsulant material adjacent to the nozzle plate/substrate assembly and substrate support. The nozzle plate adhesive, the substrate adhesive, and the encapsulant material are cured wherein at least the substrate adhesive and the encapsulant material are substantially flexible after curing.

Other exemplary embodiments may provide a method for improving micro-fluid ejection head durability. The exemplary method includes adhesively bonding a nozzle plate adjacent to a substrate with a nozzle plate adhesive to provide a nozzle plate/substrate assembly. The nozzle plate/substrate assembly is adhesively bonded in a pocket of a substrate support using a substrate adhesive. Electrical connections to the nozzle plate/substrate assembly are encapsulated with an encapsulant material that is adjacent to the nozzle plate/substrate assembly and substrate support. The nozzle plate adhesive, the substrate adhesive, and the encapsulant material are cured, wherein the nozzle plate adhesive, the substrate adhesive, and the encapsulant material are substantially flexible after curing. An advantage of the foregoing exemplary construction should be that the micro-fluid ejection head may withstand a greater drop height than an ejection head made in the absence of substantially flexible encapsulant material and substantially flexible adhesives (The drop height is the height from which a micro-fluid ejection head can function properly after a fall).

Advantages of the exemplary embodiments may include, but are not limited to, a reduction in ejector chip substrate bow, an increase in ejector head durability, increased planarity of the ejector head nozzle plate, printhead assembly planarity, and the like. The planarity of an ejector head nozzle plate is defined as the slope of each fluid ejection nozzle. Other advantages may include the provision of adhesives and encapsulant materials having improved mechanical, adhesive, and corrosion resistance properties. Reduced stresses, which may reduce ejection head fragility, may be present in the ejector head substrates due to the presence of improved encapsulant material and/or substrate adhesives according to the disclosed embodiments.

BRIEF DESCRIPTION OF THE DRAWINGS

Further features and advantages of the disclosed embodiments may become apparent by reference to the detailed description when considered in conjunction with the figures, which are not to scale, wherein like reference numbers indicate like elements through the several views, and wherein:

FIG. 2, is a perspective view, not to scale, of an ink jet printer capable of controlling a micro-fluid ejection device according to the disclosure;

FIG. 3 is a cross-sectional view, not to scale, of a portion of a micro-fluid ejection device according to an embodiment of the disclosure;

DETAILED DESCRIPTION OF EXEMPLARY EMBODIMENTS

In general, the disclosure is directed to improved compositions, structures, and methods related to, for example, thermally curable adhesives, UV curable adhesives, or dual cure adhesive systems, and encapsulant materials used to assemble component parts of micro-fluid ejection devices. More specifically, the improved adhesive; and encapsulant compositions discussed herein might be used to, for example, reduce residual stresses that may result from heat-treating micro-fluid ejection heads to harden and cure the adhesives and encapsulant materials.

Figure 1:
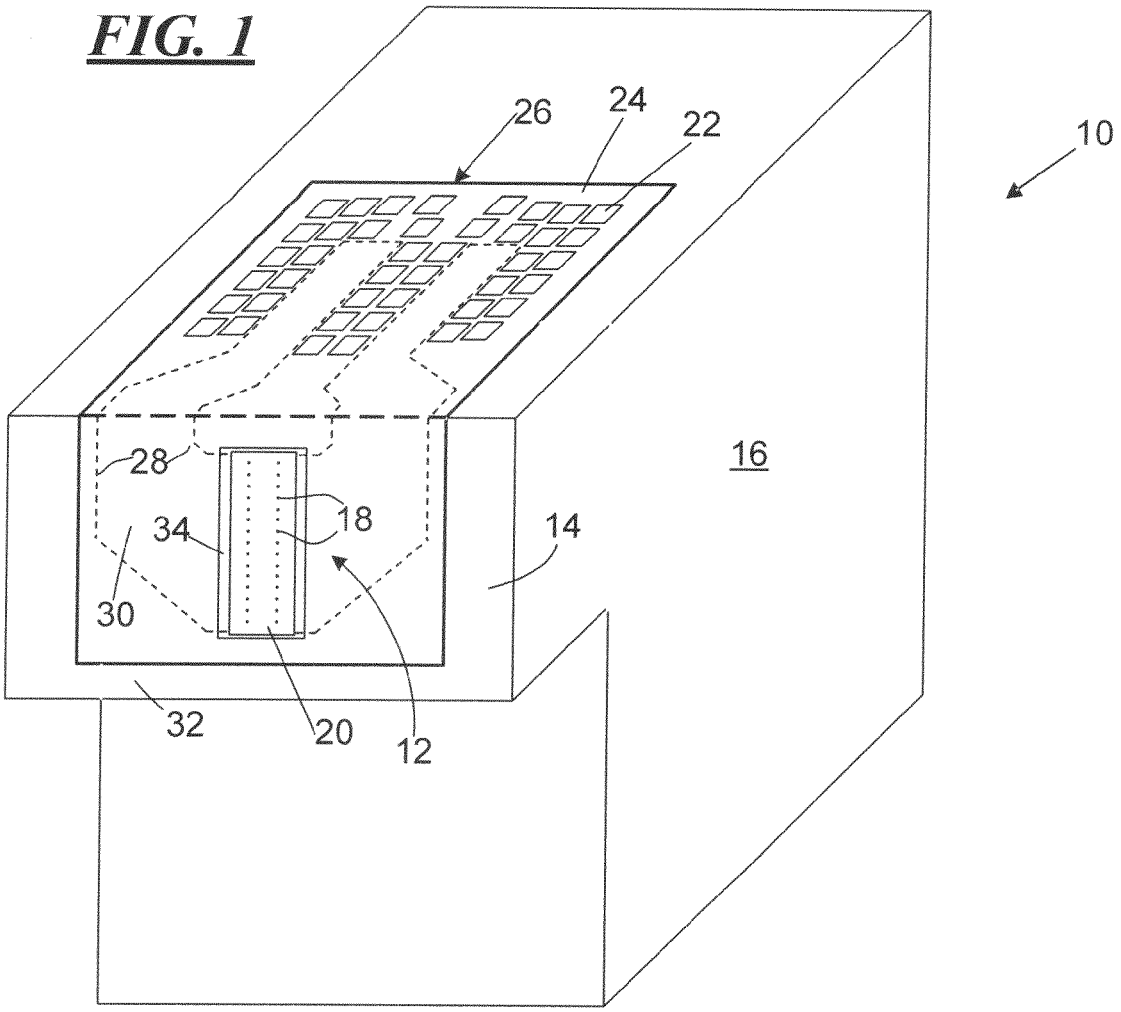
FIG. 1 is a perspective view of a micro-fluid ejection device according to an exemplary embodiment of the disclosure.

In order to more fully disclose various embodiments, attention is directed to the following description of a representative micro-fluid ejection device incorporating the improved thermally curable, UV curable adhesive, dual cure adhesive system, or other adhesive cure method and encapsulant materials described herein. With reference to FIG. 1, there is shown, in perspective view, a micro-fluid ejection device 10 including one or more micro-fluid ejection heads 12 attached to a head portion 14 of the device 10. A fluid reservoir 16 containing one or more fluids is fixedly (or removably) attached to the head portion 14 for feeding fluid to the one or more micro-fluid ejection heads 12 for ejection of fluid toward a media or receiving surface from nozzles 18 on a nozzle plate 20. Although FIG. 1 illustrates the fluid reservoir being directly attached to a head portion 14, other embodiments might attach a fluid reservoir indirectly to a head portion, such as by tubing, for example. Each reservoir 16 may contain a single fluid, such as a black, cyan, magenta or yellow ink or may contain multiple fluids. In the illustration shown in FIG. 1, the device 10 has a single micro-fluid ejection head 12 for ejecting a single fluid. However, the device 10 may contain two or more ejection heads for ejecting two or more fluids, or a single ejection head 12 may eject multiple fluids, or other variations on the same.

In order to control the ejection of fluid from the nozzles 18, each of the micro-fluid ejection heads 12 is usually electrically connected to a controller in an ejection control device, such as, for example, a printer 21 (FIG. 2), to which one or more of the devices 10 are attached. In the illustrated embodiment, connections between the controller and the device 10 are provided by contact pads 22 which are disposed on a first portion 24 of a flexible circuit 26. An exemplary flexible circuit 26 is formed from a resilient polymeric film, such as a polyimide film, which has conductive traces 28 thereon for conducting electrical signals from a source to the ejection head 12 connected to the traces 28 of the flexible circuit 26.

A second portion 30 of the flexible circuit 26 is typically disposed on an operative side 32 of the head portion 14. The reverse side of the flexible circuit 26 typically contains the traces 28 which provide electrical continuity between the contact pads 22 and the micro-fluid ejection heads 12 for controlling the ejection of fluid from the micro-fluid ejection heads 12. TAB bond or wire bond connections, for example, are made between the traces 28 and each individual micro-fluid ejection head 12 as described in more detail below.

Exemplary connections between a flexible circuit and a micro-fluid ejection head are shown in detail by reference to FIG. 3. As described above, flexible circuits 26 contain traces 28 which are electrically connected to a substrate 34. The substrate 34 may be part of an ejector chip having resistors and/or other actuators, such as piezoelectric devices or MEMs devices for inducing ejection of fluid through nozzles 18 of a nozzle plate 20 toward a media or receiving surface. Connection pads 36 on the flexible circuits 26 are operatively connected to bond pads 38 on the substrate 34, such as by TAB bonding techniques or by use of wires using a wire bonding procedure through window 42 in the circuit 26 and or nozzle plate 20.

As shown in FIG. 3, the substrate 34 is attached to the head portion 14, such as in a chip pocket 46. Prior to attaching the substrate 34 to the head portion 14, a nozzle plate 20 may be adhesively attached to the ejector chip using adhesive 48 (in another embodiment, a nozzle plate may be attached to the ejector chip by forming the nozzle plate on the substrate using photoimageable techniques). The assembly provided by the nozzle plate 20 attached to the substrate 34 is referred to herein as the nozzle plate/substrate assembly 20/34 (FIG. 3). In some embodiments, the assembly 20/34 encompasses the micro-fluid ejection head itself.

The adhesive 48 may be a heat curable adhesive such a B-stageable thermal cure resin, including, but not limited to phenolic resins, resorcinol resins, epoxy resins, ethylene-urea resins, furane resins, polyurethane resins and silicone resins. The adhesive may also be a UV cure adhesive, or incorporate another cure method. The adhesive 48 located between the nozzle plate 20 and the substrate 34 in FIG. 3, may be cured before attaching the substrate 34 to the head portion 14 and, in an exemplary embodiment, the adhesive 48 has a thickness ranging from about 1 to about 25 microns. In some embodiments, the adhesive is a flexible adhesive selected from a flexible adhesive composition having a relatively low shear modulus, a relatively low Young's modulus, and a glass transition temperature below about 90° C., described in more detail below.

After bonding the nozzle plate 20 and substrate 34 together, the nozzle plate/substrate assembly 20/34 may be attached to the head portion 14 in chip pocket 46 using a substrate adhesive, such as die bond adhesive 50. In other embodiments of the disclosure, the substrate adhesive 50 used to connect the nozzle plate/substrate assembly 20/34 to the head portion 14 includes a flexible adhesive having a relatively low shear modulus, a relatively low Young's modulus, and a glass transition temperature below about 90° C. described in more detail below.

For the purposes of this disclosures, "shear modulus" involves the relation of stress to strain according to Hooke's Law as shown in Equation (1) as follows:

$$(\text{stress})=\mu(\text{strain}) \tag{1}$$

In Equation (1), "μ" represents a quantity often referred to as rigidity. When the relationship illustrated by Equation (1) is applied to a force "F" across a given area "A", Equation (1) may be more specifically represented by Equation (2) as follows:

$$F/A=\mu(\Delta L/L) \tag{2}$$

In Equation (2) above, the variable "L" represents original length of an object before said object was acted upon by force F. "ΔL" represents the change in length occurring after force "F" has acted upon the object. Therefore, the rigidity ("μ") of the object is a proportionality constant relating the pressure applied to an object with the ratio between the object change in length with the objects original length.

When Equation (2) and a given rigidity value "μ" are used to determine elastic properties of an object, Equation (3) shown below, is used to derive a shear modulus value from the rigidity "μ" value determined in Equation (2). Equation (3) is shown below as follows:

$$\mu=E/2(L+\nu) \tag{3}$$

In Equation (3) above, shear modulus is the proportional relationship between rigidity "μ" and the right hand side of the equation, including the Poisson ratio "ν" and Young's modulus "E". The Young's modulus is defined as the limit, for small strains, of the rate of change of stress with strain. Young's modulus may be determined from the slope of a stress-strain curve created during tensile tests conducted on a sample of material by the following equation:

$$Y=Fl_0/A_0\Delta l$$

where Y is the Young's modulus measured in pascals, F is a force applied to an object, $A_0$ is an original cross-sectional area of the object through which the force is applied, Δl is a change in length of the object and $l_0$ is an original length of the object.

Applying Hooke's law and elasticity theory to physical properties of micro-fluid ejection heads, reliable data may be established to correlate the elastic properties of adhesives and encapsulants with the effect of said adhesives on one or more surfaces of a micro-fluid ejection head. Shear modulus values are dependent on temperature, therefore, a given shear modulus value for a given adhesive or encapsulant will be given in pressure units at a specific temperature. Various embodiments of the disclosure include compositions with shear modulus values of less than 15 MPa at 25° C. as determine by a rheometer from TA Instruments of New Castle, Del. under the trade name ARES in a dynamic parallel plate configuration with a frequency of 1.0 rad/sec and a strain of 0.3% after the material is cured.

In a prior art ejection head, a relatively rigid, or non-flexible encapsulant material is used to encapsulate and protect the traces 28 (also known as lead beams) and bond pads 38 on substrate 34. Exploded views of micro-fluid ejection device, components of the micro-fluid ejection device, and encapsulant material placement are illustrated in FIGS. 3-8.

Figure 4:
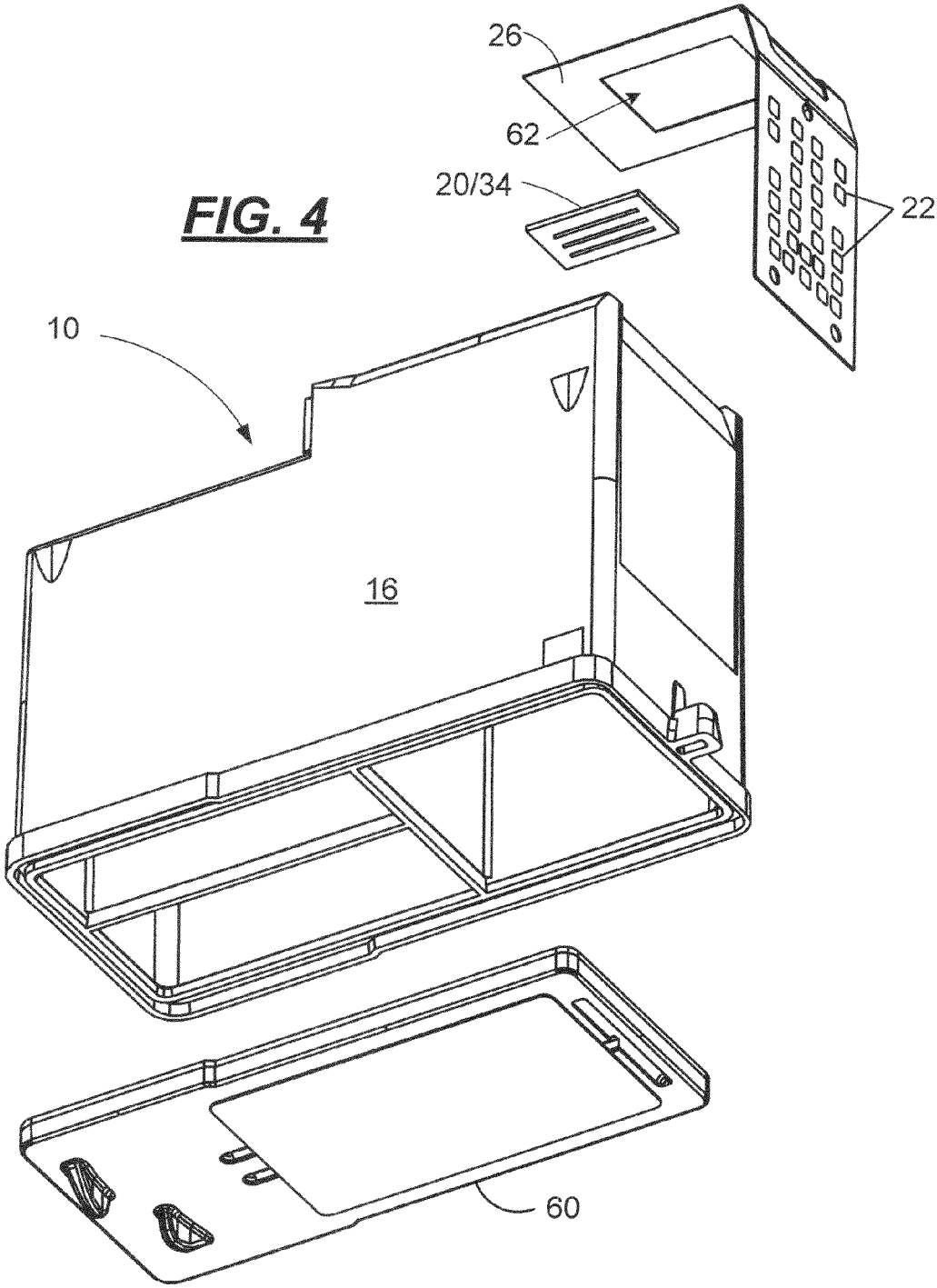
FIGS. 4-5 are exploded perspective views, not to scale, of a micro-fluid ejection device according to an exemplary embodiment of the disclosure.
Figure 5:
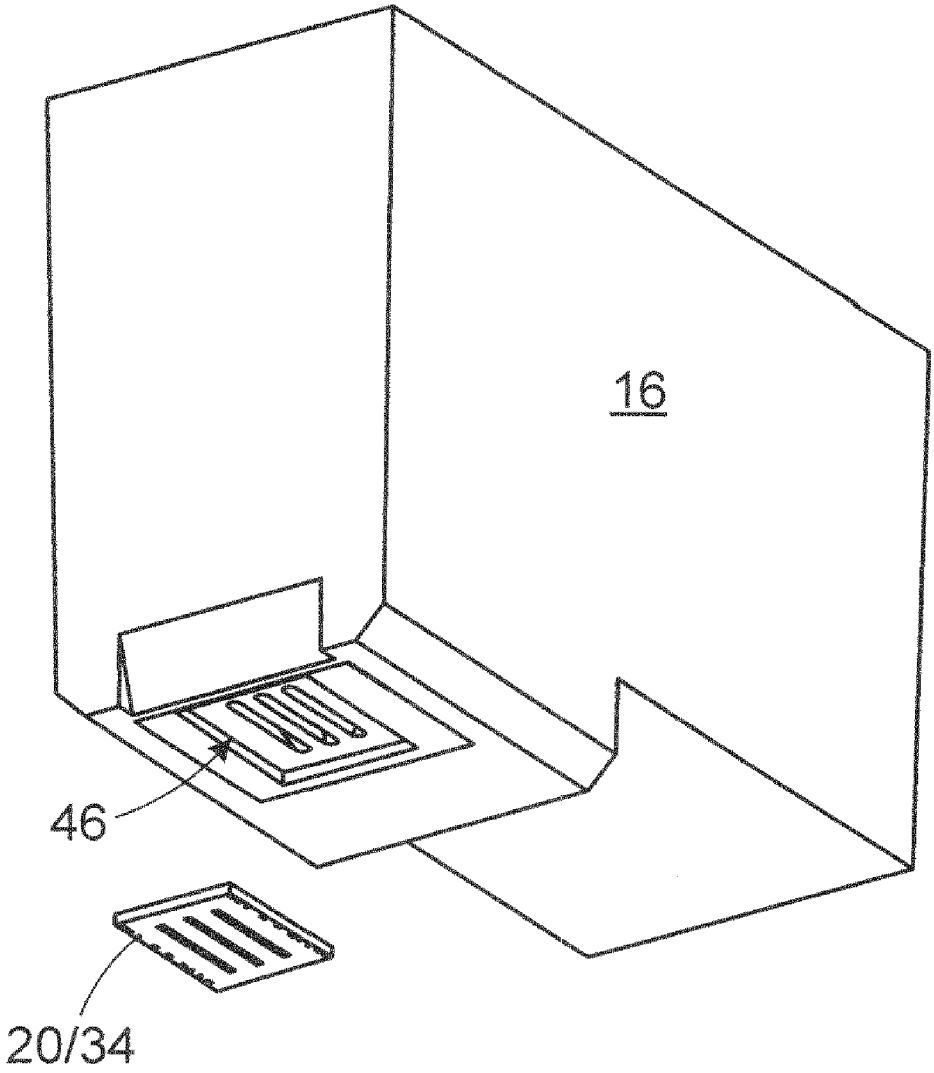

FIGS. 4-5 are exploded, perspective views of a micro-fluid ejection device 10 illustrating a multi-cavity fluid reservoir 16 and cover 60 therefore. A nozzle plate/substrate assembly 20/34 is attached in the chip pocket 46 of the reservoir 16 (FIG. 5), and the flexible circuit 26 is attached to the substrate 34 as described above.

As shown in more detail in FIG. 3, the flexible circuit 26 includes a window 42 containing traces 28 for connection to the bond pads 38 on the substrate 34. After connecting the traces 28 to the bond pads 38, encapsulant material 52 is deposited to substantially surround the traces 28 and bond pad 38 connections to protect the connections from corrosion. Such encapsulant material 52 is shown on top of the traces 28 but may include encapsulant material provided by the substrate adhesive 50 or other encapsulant material provided on an opposite side of the traces 28 to substantially surround the traces 28 and bond pads 38, and so that the encapsulant material 52 extends over the nozzle plate 20, and flex circuit 26.

Figure 6:
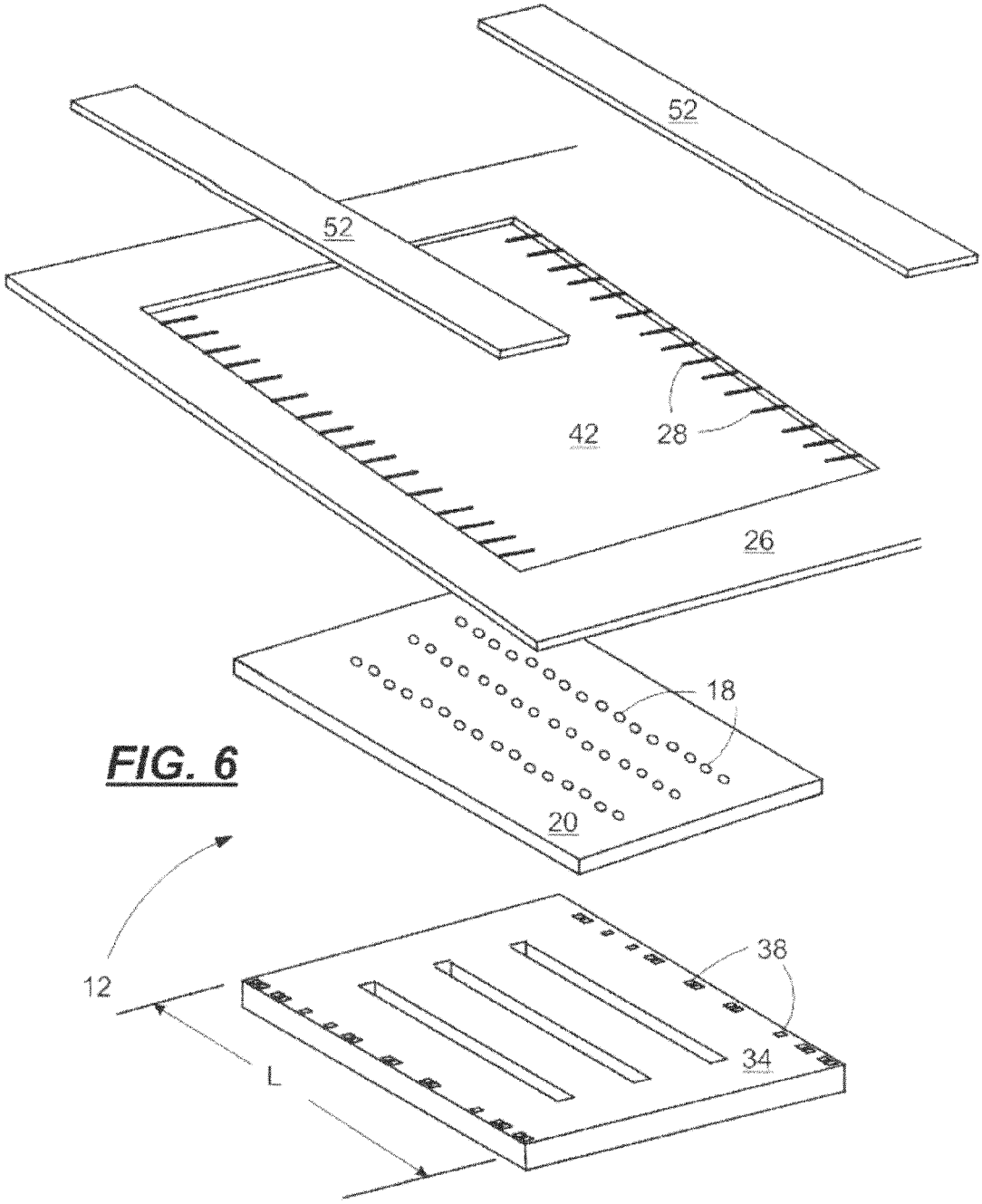
FIG. 6 is an exploded perspective view of a micro-fluid ejection head assembly and encapsulant material according to an embodiment of the disclosure.
Figure 7:
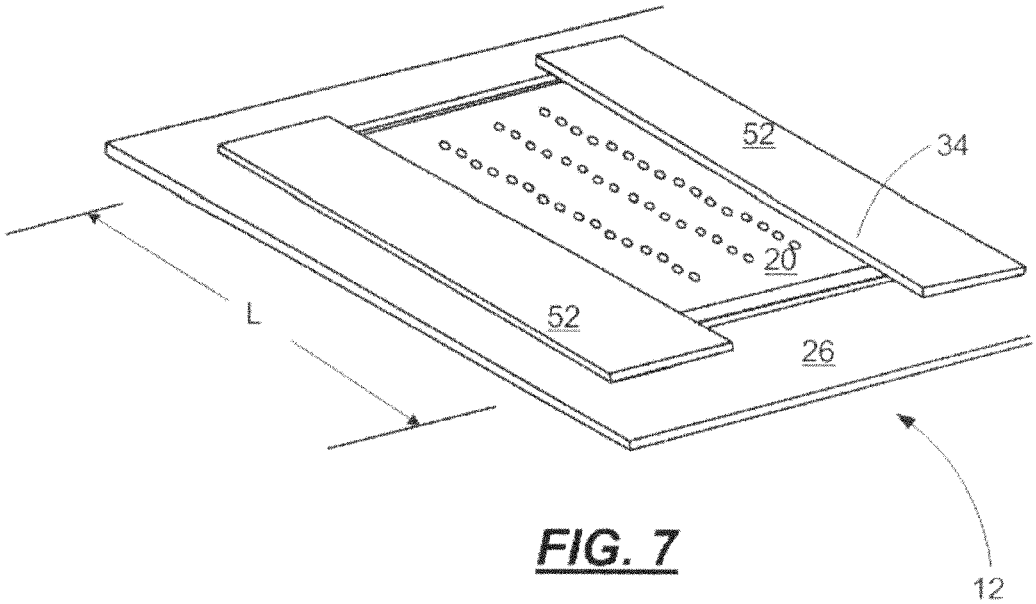
FIG. 7 is a perspective view of the micro-fluid ejection head assembly of FIG. 6.

In the embodiment illustrated in FIG. 6, bond pads 38 are along a length L of the substrate 20. Accordingly longitudinal strips of encapsulant material 52 are provided along the length L of the substrate as shown in FIG. 7 to cover the conductive surfaces.

Figure 8:
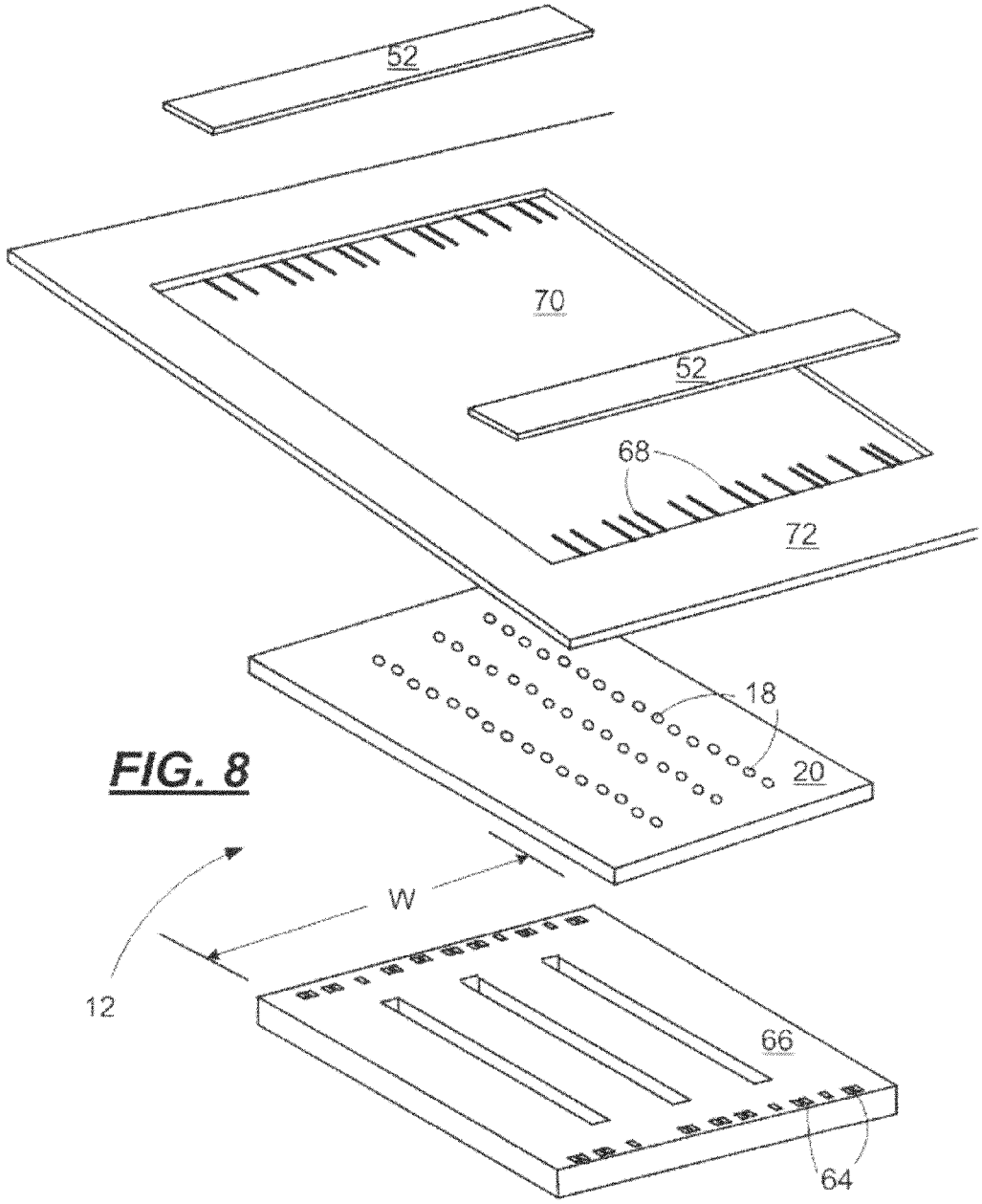
FIG. 8 an exploded perspective view of a micro-fluid ejection head assembly and encapsulant material according to another embodiment of the disclosure.

In an alternative embodiment, illustrated in FIG. 8, bond pads 64 are along a width W of a substrate 66. Likewise, wires or traces 68 in a window 70 of a flexible circuit 72 are arranged to correspond to the bond pads 64 on the substrate 66. In this embodiment, encapsulant material 52 substantially surrounds the bond pad 64 and wire 68 connections, and overlaps the nozzle plate 20, and a portion of the flexible circuit 72 along the width W of the substrate 66. In other embodiments, bond pads may be along both the width W and length L of the substrate 20 or 66 with corresponding encapsulant material disposed along the width W or length L thereof. It will be appreciated that the substrate adhesive 50 (FIG. 3) may be sufficient to encapsulate at least a portion of the wires 28 or 68 and bond pads 38 or 64 from the chip pocket 46 side of the head portion 14. An additional encapsulant 74 may be dispensed along an opposite side of the nozzle plate/substrate assembly 20/34 or 20/66 to further protect the conductive surfaces from corrosive environments.

Figure 9:
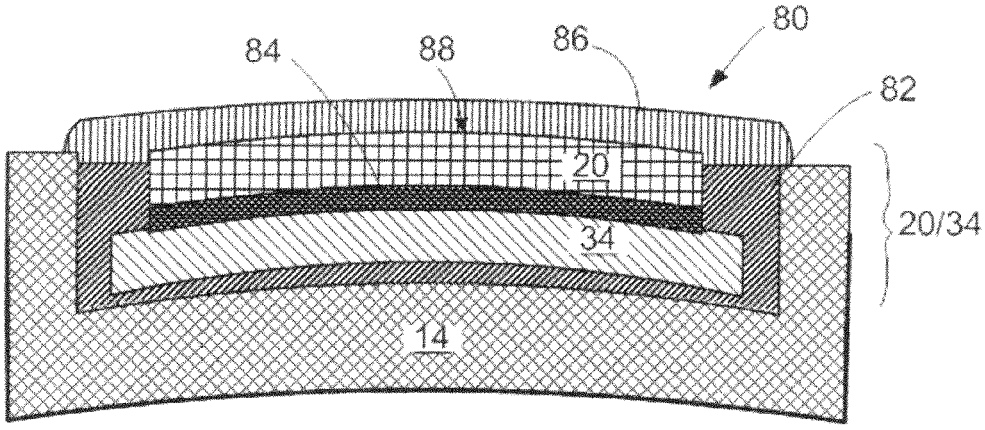
FIG. 9 PRIOR ART
FIG. 9 is a cross-sectional view, not to scale, of a micro-fluid ejection device incorporating a prior art encapsulant material.

Regardless of whether the encapsulant material is placed along the length L or the width W or both, curing of the encapsulant material and adhesives may result in bowing of the ejection head structure if one or more of the nozzle plate adhesive 48, substrate adhesive 50, and encapsulant material 52 or 74 is provided by a substantially non-flexible composition. With reference to FIG. 9, a cross-sectional view of a non-planar micro-fluid ejection head 80 (e.g., nozzle plate/substrate assembly 20/34) containing prior art adhesives 82 and 84 and/or encapsulant material 86 is illustrated. (For purposes of clarity only, details of the connections are not illustrated).

In the prior art ejection head 80, one or more of the adhesives 82 or 84 or the encapsulant material 86 is relatively rigid and has a relatively high shear modulus and a relatively high glass transition temperature. For example, the prior art encapsulant material 86 has a shear modulus of about 15 MPa at 25° C. and a glass transition temperature of about 92° C. A prior art die bond adhesive 82 has a shear modulus of about 15.4 MPa at 25° C. and a glass transition temperature of about 94° C.

The glass transition temperature of a material with elastic properties is the temperature at which the material transitions to more brittle physical properties or more elastic physical properties, depending on whether the temperature is decreasing or increasing, respectively. Upon curing, as the adhesives 82, 84, and encapsulant material 86 are cooled below their glass transition temperatures, the adhesives 82, 84, and encapsulant material 86 becomes significantly more brittle than before reaching their glass transition temperatures. If the adhesives 82, 84, and encapsulant material 86 are stretched or compressed at a temperature below their glass transition temperatures, the adhesives 82, 84, and encapsulant material 86 may crack or buckle, or cause bending of the substrate 34 and/or head portion 14. Therefore, using adhesives and encapsulant materials with lower glass transition temperatures will decrease the chances of the adhesives or encapsulant materials cracking or buckling.

Similarly, considering that shear modulus values directly relate to how brittle an adhesive or encapsulant material will be at a given temperature, adhesives or encapsulant materials having lower shear modulus values are more flexible at lower temperatures, thereby decreasing the likelihood of the adhesive or encapsulant material cracking or buckling. Adhesive or encapsulant material cracking may result in a compromised fluid seal, whereby micro-fluid ejection fluid leaks from the nozzle plate/substrate assembly 20/34 might cause undesirable deposits of fluid, and/or corrosion of electrical components.

High curing temperatures may also cause increased micro-fluid ejection head fragility. Increased fragility of micro-fluid ejection heads increases the chances for micro-fluid ejection products becoming unfit for use due to shattering of micro-fluid ejection heads and other parts of the micro-fluid ejection device when the ejection heads are dropped or otherwise impacted by a sharp blow. Chip fragility is believed to increase in severity because the adhesives 82, 84 and encapsulant material 86 reach their glass transition temperature ($T_g$) before the nozzle plate/substrate assembly 20/34 and head portion 14 have finished cooling and contracting relative to one another after the curing of the adhesives 82, 84, and encapsulant material 86, imparting stress onto the nozzle plate/substrate assembly 20/34. Adhesives and encapsulant materials having lower shear modulus values and lower glass transition temperatures may be cured with lower temperatures thereby, decreasing the chances for increased micro-fluid ejection head fragility.

Upon curing, stresses in the ejection head 80 are caused by the adhesives 82, 84, and encapsulant material 82 that expand or contract during a curing process at a different rate than the other components of the ejection head 80. Other components of the ejection head 12 contract while the cured adhesives 82, 84, and encapsulant material 86 remain in an expanded state during cooling. The resulting stresses cause deformation within the substrate 20 and/or nozzle plate 34 leading to a non-planar surface 88, i.e., chip bow or nozzle plate bow and substrate warping, as shown in FIG. 9, that may cause misdirection of fluid ejected from the nozzles 18.

Chip bowing typically results from the nozzle plate/substrate assembly 20/34 and the head portion 14 having dissimilar coefficients of thermal expansion, since the substrate 20 bonded to the head portion 14 most commonly is silicon or ceramic and the portion 14 is, for example, typically a polymeric material such as a modified phenylene oxide. Thus, the adhesives and encapsulant materials should be flexible enough to accommodate both the dissimilar expansions and contractions of the nozzle plate/substrate assembly 20/34 and the head portion 14. Chip bowing may result in nozzles being misaligned or aligned at an undesired angle (often called "planarity" of nozzles), which may also diminish the quality of fluid ejected from the nozzles.

Figure 10:
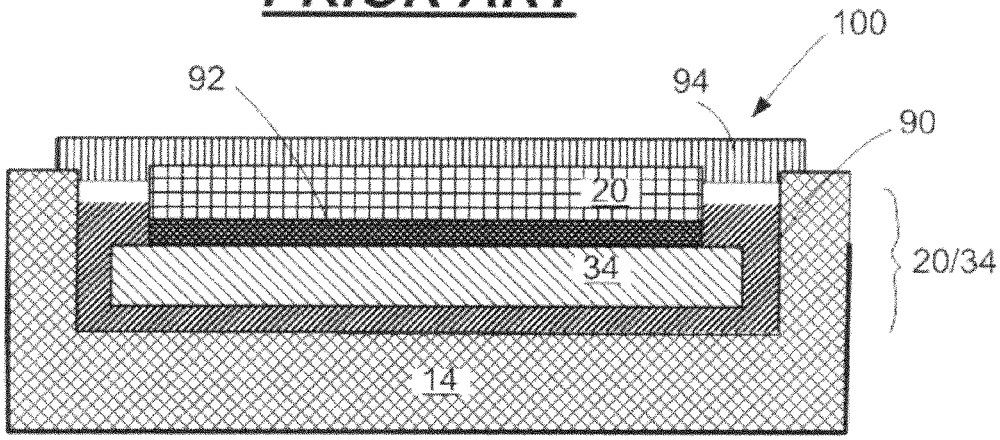
FIG. 10 is a cross-sectional cutaway side view, not to scale, of a portion of a micro-fluid ejection device according to an embodiment of the disclosure.

In an exemplary embodiment of disclosure, adhesives and encapsulant materials are used that have glass transition temperature below the temperature to which the head portion 14 is cooled, relatively low shear moduli and relatively low Young's moduli. For example, an encapsulant material with a glass transition temperature of less than about 80° C., such as one having a glass transition temperature of less than about 65° C. and a shear modulus of less than about 15 MPa at 25° C., for example less than 10 MPa at 25° C. may be used in an exemplary embodiment. Accordingly, to another exemplary embodiment of the disclosure, substrate and nozzle plate adhesives are used that have glass transition temperatures below the temperature to which the head portion 14 is cooled. For example, adhesives with glass transition temperatures of less than about 65° C., such as ones having a glass transition temperature of less than about 50° C. or less than about 25° C. might be used in exemplary embodiments. FIG. 10 illustrates an ejection head 100 having improved planarity as a result of using a substrate adhesive 90, a nozzle plate adhesive 92, and/or an encapsulant material 94 according to the disclosure.

For the purposes of certain embodiments in this disclosure, "relatively low shear modulus" is defined as a shear modulus at least lower than about 15 MPa at 25° C., for example lower than about 10 MPa at 25° C. "Relatively low shear modulus" may, however, be defined as a shear modulus lower than about 5.0 MPa at 25° C. for certain exemplary embodiments disclosed herein.

In an exemplary embodiment, the encapsulant material 94 may be composition including (1) from about 45 to about 95 percent by weight of at least one cross-linkable epoxy resin having a flexible backbone; (2) from about 5 to about 20 percent by weight of at least one thermal curative agent selected from the group of imidazoles, amines, peroxides, organic accelerators, sulfur, and mixed onium salts such as arsonium, antimonium and bimnuthonium salts; and (3) from about 0 to about 10 percent by weight filler, wherein the composition exhibits a relatively low shear modulus upon curing. A UV curable material may be used in this embodiment as well with similar chemistries, and appropriate cure components. In some variations of these exemplary embodiments, the encapsulant material may include from about 0 to about 5 percent by weight silane coupling agent. In the embodiments described above, the filler may include from about 0 to about 10 percent by weight fumed silica or another filler component such as clay or functionalized clay, silica, talc, carbon black, carbon fibers. In yet other exemplary embodiments, the encapsulant material may include from about 5 to about 20 percent by weight of a phenolic cross-linking agent.

More specific exemplary embodiments of the composition of the encapsulant material 94 according to the disclosure are listed in Tables 1 through Table 6 below.

TABLE 1

(Composition 1)

| Material | Concentration (percent by weight) | Trade name | Supplier |
|---|---|---|---|
| Flexible epoxy resin | 70.0-85.0 | EXA-4850 | Dainippon Ink |
| Bisphenol-M | 8.0-10.0 | Bisphenol M | Aldrich |
| Imidazole catalyst | 9.0-11.0 | CUREZOL C17Z | Air Products |
| Epoxy Silane | 0.5-1.5 | A-187 | GE Silicones |
| Amine adduct | 0-5.0 | ANCAMINE 2337 | Air Products |
| Fumed Silica | 0-5.0 | TS-720 | Cabot |

As shown above, composition 1 includes from about 70 to about 85 percent by weight multi-functional epoxy resin and from about 8 to about 10 percent by weight phenolic cross-linking agent. The composition also includes from about 9 to about 11 percent by weight of an imidazole catalyst and from about 0 to about 5 weight percent filler. Optional components include from about 0.5 to about 1.5 wt. % silane coupling agent and from about 0 to about 5 wt. % amine adduct. As shown in Table 10, Composition 1 has a relatively low Young's modulus value of 43 MPa, a relatively low shear modulus value of about 4.4 MPa at 25° C., and a low glass transition temperature of about 30.8° C.

There are a number of epoxy resins, curing agents, and fillers available for application with various embodiments of the invention. In the first composition illustrated in Table 1, an exemplary multi-functional epoxy resin is available from Dainippon Ink and Chemicals, Inc. of Tokyo, Japan under the trade name EPICLON EXA-4850.

A suitable phenolic cross-linking agent is available from Sigma Aldrich Company under the trade designation Bisphenol-M. A useful curing agent is available from Air Products and Chemicals, Inc. under the trade name CUREZOL C17Z. A suitable epoxy silane coupling agent is available from GE Advanced Materials, Silicones of Wilton, Conn. under the trade name SILQUEST A-187 SILANE. A suitable filler, such as fumed silica, is available from a number of different suppliers. For example, fumed silica is available from Cabot Corporation of Boston, Mass. under the trade name CAB-O-SIL TS-720. A suitable amine adduct is available from Air Products and Chemical, Inc. under the trade name ANCAMINE 2337.

TABLE 2

(Composition 2)

| Material | Concentration (percent by weight) | Trade name | Supplier |
|---|---|---|---|
| Flexible epoxy resin | 75.0-90.0 | EXA-4850 | Dainippon Ink |
| Imidazole catalyst | 10.0-11.0 | CUREZOL C17Z | Air Products |
| Epoxy Silane | 0.5-1.0 | A-187 | GE Silicones |
| Amine adduct | 0-5.0 | ANCAMINE 2337 | Air Products |
| Fumed Silica | 0-5.0 | TS-720 | Cabot |

As provided in Table 2, Composition 2 includes from about 75 to about 90 percent by weight flexible epoxy resin, from about 10 to about 11 percent by weight of imidazole catalyst thermal curative agent, from about 0.5 to about 1.0 percent by weight epoxy silane coupling agent, from about 0 to about 5 percent by weight of amine adduct, and from about 0 to about 5 percent by weight fumed silica. Other embodiments may include, but are not limited to, a UV initiator for UV curative processes. As shown in Table 10, Composition 2 has a low Young's modulus value of 6 MPa, a low shear modulus value of about 1.75 MPa at 25° C. and a glass transition temperature of about 20° C.

Other suitable encapsulant material compositions that may be used according to the disclosure are listed in Tables 3-6.

TABLE 3

(Composition 3)

| Material | Concentration (percent by weight) | Trade name | Supplier |
|---|---|---|---|
| Flexible epoxy resin | 78.0-85.0 | EXA-4850 | Dainippon Ink |
| Bisphenol-F | 4.0 | 830-LVP | Dainippon Ink |
| Imidazole catalyst | 9.0-10.0 | CUREZOL C17Z | Air Products |
| Epoxy Silane | 1.0 | A-187 | GE Silicones |
| Amine adduct | 0-4.0 | ANCAMINE 2337 | Air Products |
| Fumed Silica | 0-4.0 | TS-720 | Cabot |

TABLE 4

(Composition 4)

| Material | Concentration (percent by weight) | Trade name | Supplier |
|---|---|---|---|
| Flexible epoxy resin | 74.0-80.0 | EXA-4850 | Dainippon Ink |
| Bisphenol-F | 8.0-9.0 | 830-LVP | Dainippon Ink |
| Imidazole catalyst | 9.0-10.0 | CUREZOL C17Z | Air Products |
| Epoxy Silane | 1.0 | A-187 | GE Silicones |

TABLE 4-continued (Composition 4)

| Material | Concentration (percent by weight) | Trade name | Supplier |
|---|---|---|---|
| Amine adduct | 0-4.0 | ANCAMINE 2337 | Air Products |
| Fumed Silica | 0-4.0 | TS-720 | Cabot |

TABLE 5

(Composition 5)

| Material | Concentration (percent by weight) | Trade name | Supplier |
|---|---|---|---|
| Flexible epoxy resin | 61.0-67.0 | EXA-4850 | Dainippon Ink |
| Bisphenol-F | 20.0-22.0 | 830-LVP | Dainippon Ink |
| Imidazole catalyst | 9.0-10.0 | CUREZOL C17Z | Air Products |
| Epoxy Silane | 1.0 | A-187 | GE Silicones |
| Amine adduct | 0-4.0 | ANCAMINE 2337 | Air Products |
| Fumed Silica | 0-4.0 | TS-720 | Cabot |

TABLE 6

(Composition 6)

| Material | Concentration (percent by weight) | Trade name | Supplier |
|---|---|---|---|
| Flexible epoxy resin | 49.0-53.0 | EXA-4850 | Dainippon Ink |
| Bisphenol-F | 33.0-36.0 | 830-LVP | Dainippon Ink |
| Imidazole catalyst | 9.0-10.0 | CUREZOL C17Z | Air Products |
| Epoxy Silane | 1.0 | A-187 | GE Silicones |
| Amine adduct | 0-4.0 | ANCAMINE 2337 | Air Products |
| Fumed Silica | 0-4.0 | TS-720 | Cabot |

The compositions provided in Tables 3-6 are similar to the composition of Table 2 except that they contain from about 4 to about 36 weight percent bisphenol-F cross-linking agent, from about 49 to about 85 weight percent of the flexible epoxy resin, from about 9 to about 10 percent by weight of imidazole catalyst thermal curative agent, and about 1 weight percent silane coupling agent. Alternatively, UV curative initiators or other curative agents may be used. As with the other compositions, Compositions 3-6 may also include from about 0 to about 4 wt. % filler and from about 0 to about 4 wt. % amine adduct. As shown in Table 10, Composition 3 has a Young's modulus value of 23 MPa, a shear modulus value of about 3.9 MPa at 25° C., and a glass transition temperature of about 27.7° C. Composition 4 has a Young's modulus value of 64 MPa, a shear modulus value of about 6.2 MPa at 25° C., and a glass transition temperature of about 30.7° C. Composition 5 has a Young's modulus value of 406 MPa, a shear modulus value of about 8.3 MPa at 25° C., and a glass transition temperature of about 45.4° C., Composition 6 has a Young's modulus value of 1300 MPa, a shear modulus value of about 8.7 MPa at 25° C., and a glass transition temperature of about 60° C. By comparison, as shown in FIG. 10, a conventional encapsulant material available from Engineered Materials Systems, Inc of Delaware, Ohio under the trade name EMS 502-39-1 has a Young's modulus value of 2000 MPa, a shear modulus value of 15 MPa at 25° C., and a glass transition temperature of about 92° C.

Exemplary adhesive compositions that may be used as substrate and/or nozzle plate adhesives are illustrated in Tables 7-9.

TABLE 7

(Composition 7)

| Material | Concentration (percent by weight) | Trade name | Supplier |
|---|---|---|---|
| Flexible epoxy resin | 37.8 | GE-35 | CVC |
| Aliphatic flexible epoxy resin | 37.8 | Epalloy 3-23 | CVC |
| Bisphenol M | 8.4 | Bisphenol M | Aldrich |
| Imidazole catalyst | 9.5 | Curezol C17Z | Air Products |
| Epoxy silane | 0.2 | A-187 | Crompton |
| Titanium dioxide | 4.2 | Ti-Pure R-900 | DuPont |
| Fumed Silica | 2.1 | TS-720 | Cabot |

TABLE 8

(Composition 8)

| Material | Concentration (percent by weight) | Trade name | Supplier |
|---|---|---|---|
| Flexible epoxy resin | 33.6 | GE-35 | CVC |
| Aliphatic flexible epoxy resin | 42.0 | Epalloy 3-23 | CVC |
| Bisphenol M | 8.4 | Bisphenol M | Aldrich |
| Imidazole catalyst | 9.5 | Curezol-17-Z | Air Products |
| Epoxy silane | 0.2 | A-187 | Crompton |
| Titanium dioxide | 4.2 | Ti-Pure R-900 | DuPont |
| Fumed Silica | 2.1 | TS-720 | Cabot |

As shown above, Compositions 7-8 includes from about 30 to about 40 percent by weight multi-functional epoxy resin; from about 35 to about 45 percent by weight aliphatic di-functional epoxy resin; and about 8 percent by weight phenolic cross-linking agent. The composition also includes about 10 percent by weight of an imidazole catalyst and about 6 weight percent fillers. As shown in Table 10, Composition 7 has Young's modulus of 1 MPa, a relatively low shear modulus value of about 0.4 MPa at 25° C., and a low glass transition temperature of about 10° C. Composition 8 has Young's modulus of 2 MPa, a relatively low shear modulus value of about 0.5 MPa at 25° C., and a low glass transition temperature of about 13° C.

There are a number of epoxy resins, curing agents, and fillers available for application with various embodiments of the invention. In the composition illustrated in Tables 7 and 8, an exemplary multi-functional epoxy resin is available from CVC Specialty Chemicals, Inc. under the trade name ERISYS GE-35. An exemplary aliphatic di-functional epoxy resin is available from CVC Specialty Chemicals, Inc. under the trade name EPALLOY 3-23. Suitable fillers such as titanium dioxide, and fumed silica are available from a number of different suppliers. For example, titanium dioxide is available from DuPont Titanium Technologies under the trade name TI-PURE R-900 and fumed silica is available from Cabot Corporation of Boston, Mass. under the trade name CAB-O-SIL TS-720.

Another useful substrate or nozzle plate adhesive composition is contained in Table 9

TABLE 9

(Composition 9)

| Material | Concentration (percent by weight) | Trade name | Supplier |
|---|---|---|---|
| Flexible epoxy resin | 19.9 | GE-35 | CVC |
| Epoxy siloxane | 19.9 | SIB1115.0 | Gelest |
| Carboxyl-terminated butadiene | 39.7 | 2000X162 | Noveon |
| Amine adduct | 10.7 | Ancamine 2337 | Air Products |
| Epoxy Silane | 0.2 | A-187 | GE Silicones |
| Titanium dioxide | 4.0 | Ti-Pure R-900 | Dupont |
| Fumed Silica | 5.6 | TS-720 | Cabot |

Composition 9 includes about 20 percent by weight multifunctional epoxy resin; about 20 percent by weight epoxy siloxane resin; 40 percent by weight carboxyl-terminated butadiene; and about 11 percent by weight of an amine adduct thermal curative agent. A UV initiator may be used instead of the thermal curative agents in an alternative embodiment. The composition also includes about 0.2 percent by weight epoxy silane, about 4 percent by weight titanium dioxide, and 5.5 percent by weight fumed silica. As shown in Table 10, Composition 9 has a Young's modulus value of 0.5 MPa, a substantially low shear modulus value of about 0.175 MPa at 25° C., and a low glass transition temperature of about −6.7° C.

In accordance with the foregoing composition, the epoxy siloxane that may be used is available from Gelest, Inc. is under the trade designation SIB1115.0. The carboxyl-terminated butadiene that may be used is available from Noveon Specialty Chemicals of Cleveland, Ohio under the trade name HYCAR CTB 2000X162.

A comparison of the shear modulus and glass transition temperature properties of the Compositions 7-9 compared to a conventional substrate adhesive available from Emerson & Cuming of Monroe Township, N.J. under the trade name ECCOBOND 3193-17 are provided in Table 10.

TABLE 10

| Sample | Young's Modulus (MPa) | Shear Modulus (MPa) (25° C.) | Tg (° C.) |
|---|---|---|---|
| ECCOBOND 3193-17 | 3000 | 15.4 | 94.0 |
| EMS 502-39-1 | 2000 | 15.0 | 92.0 |
| Composition 1 | 43 | 4.43 | 30.8 |
| Composition 2 | 6 | 1.75 | 20.0 |
| Composition 3 | 23 | 3.9 | 27.7 |
| Composition 4 | 64 | 6.23 | 30.7 |
| Composition 5 | 406 | 8.26 | 45.4 |
| Composition 6 | 1300 | 8.72 | 60.0 |
| Composition 7 | 1 | 0.43 | 10 |
| Composition 8 | 2 | 0.52 | 13 |
| Composition 9 | 0.5 | 0.175 | −6.7 |

As illustrated in Table 10, the EMS encapsulant and the ECCOBOND adhesive have relatively high Young's modulus values of 2000 to 3000 MPa, relatively high shear modulus values of about 15 MPa at 25° C., relatively high glass transition temperatures of 92° to 94° C. as compared to Young's modulus values, the shear modulus values, and the glass transition temperatures of the Compositions 1-9. Accordingly, it is expected that the a micro-fluid ejection head 100 containing the adhesives and encapsulant materials similar to compositions 1-9 may provide improved planarity of the nozzle plates 20, comparable corrosion resistance, and improved durability as determined by greater drop heights of the ejection heads.

Chip bow simulation runs were made with the composition 7 as a substrate adhesive and encapsulant compositions having Young's moduli ranging from about 1 to about 3000 MPa. The results are illustrated in FIGS. 11 and 12.

Figure 11:
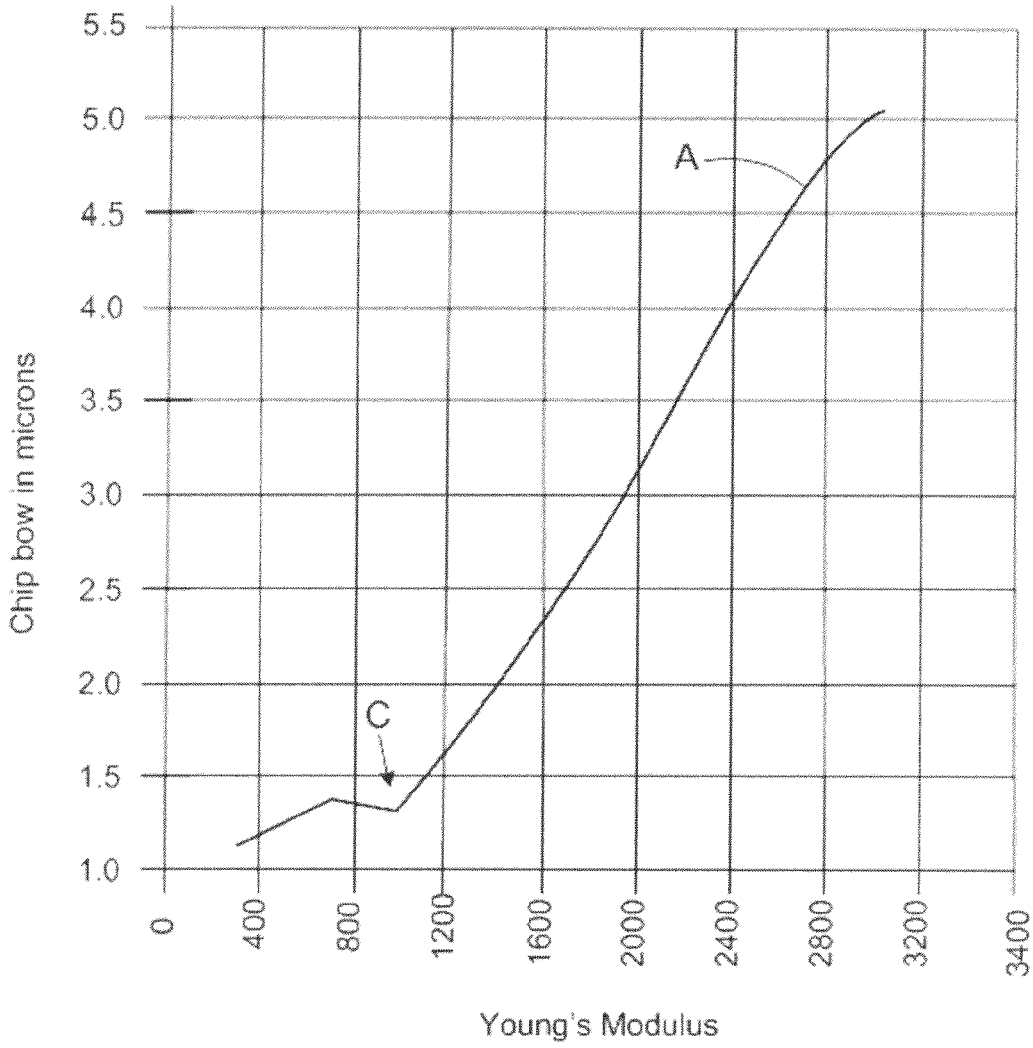
FIGS. 11 and 12 are graphical illustrations of predicted chip bow versus Young's modulus for micro-fluid ejection heads containing encapsulant materials having a range of modulus of elasticity.
Figure 12:
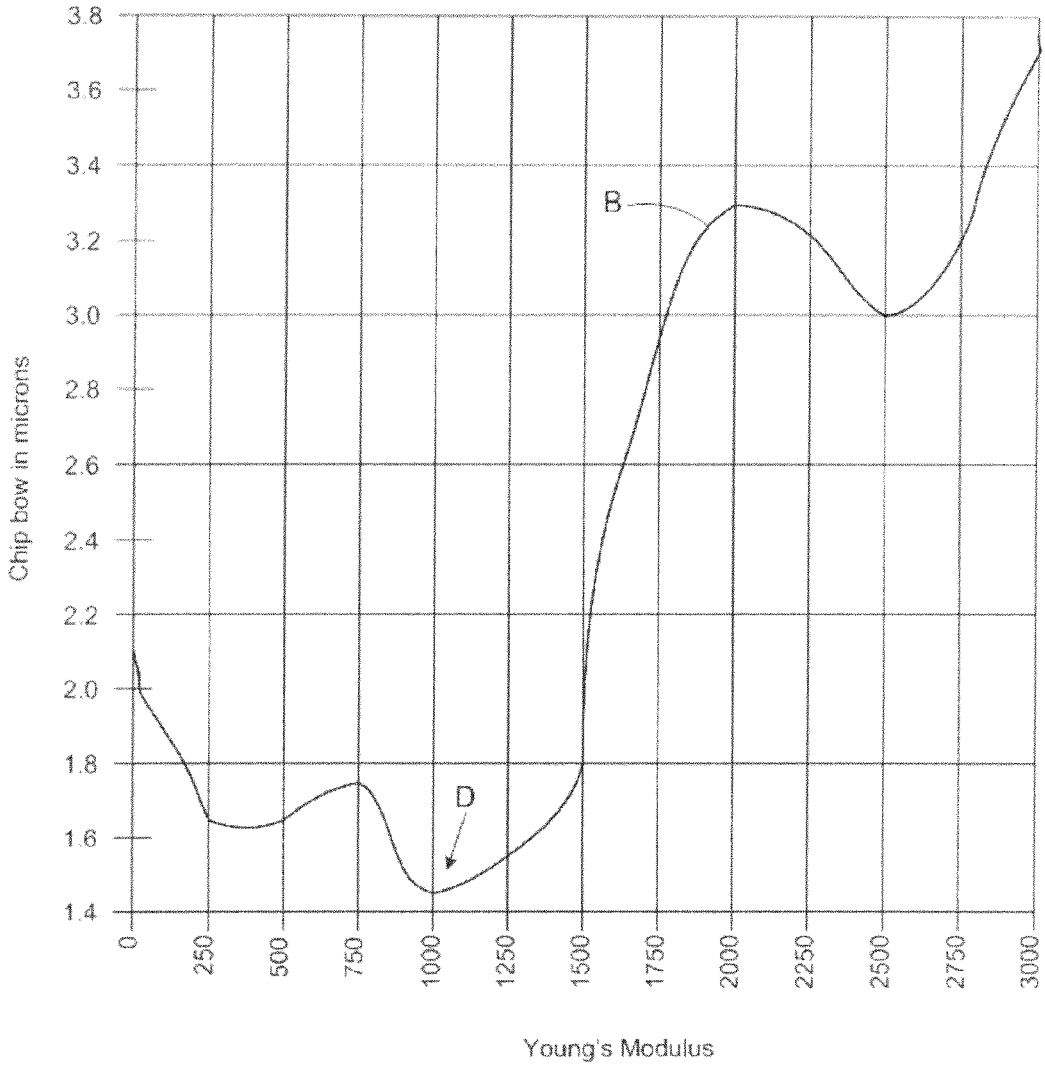

In FIG. 11, encapsulant materials having a range of Young's moduli were used with a substrate adhesive of Composition 7. The resulting curve A had a knee in the Young's modulus range of about 1000 MPa. In FIG. 12, front side and back side encapsulant materials having Young's moduli ranging from 1 to 3000 MPa were used with a substrate adhesive of Composition 7. Again the resulting curve B had a knee in the Young's modulus range of about 1000 to about 1250 MPa. The foregoing results appear to be independent of the design or configuration of the micro-fluid ejection heads. Further simulation results indicated that having substrate adhesives and encapsulant materials with substantially the same Young's moduli result in the lowest chip bow results. Accordingly, use of adhesives and encapsulant materials as described herein may significantly improve the durability and planarity characteristics of ejection heads made with the adhesives and encapsulant materials.

It is contemplated, and will be apparent to those skilled in the art from the preceding description and the accompanying drawings that modifications and/or changes may be made to the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A micro-fluid ejection head structure comprising:

a micro-fluid ejection head having a substrate and nozzle plate adhesively attached adjacent to a substrate support using a substrate adhesive, wherein the nozzle plate is adhesively attached adjacent to the substrate with a nozzle plate adhesive, and an encapsulant material for the micro-fluid ejection head adjacent to the ejection head and substrate support, wherein each of the substrate adhesive and the encapsulant material, after curing, have a Young's modulus of less than about 2000 MPa, a shear modulus at 25° C. of less than about 15 MPa, and a glass transition temperature of less than about 90° C.

2. The micro-fluid ejection head structure of claim 1, wherein the nozzle plate adhesive has a Young's modulus of less than about 2000 MPa, a shear modulus at 25° C. of less than about 15 MPa, and a glass transition temperature of less than about 90° C.

3. The micro-fluid ejection head structure of claim 1, wherein the substrate adhesive and at least a portion of the encapsulant material adjacent to electrical connections to the ejection head are substantially flexible after curing.

4. The micro-fluid ejection head structure of claim 3, wherein the nozzle plate adhesive is substantially flexible after curing.

5. The micro-fluid ejection head structure of claim 1, wherein any adhesive and encapsulant material in contact with the substrate support is substantially flexible after curing.

6. A method for reducing bowing or warping of a micro-fluid ejection head component, comprising:

adhesively bonding a nozzle plate to a substrate with a nozzle plate adhesive to provide a nozzle plate/substrate assembly;

adhesively bonding the nozzle plate/substrate assembly in a pocket of a substrate support using a substrate adhesive;

encapsulating electrical connections to the nozzle plate/substrate assembly with an encapsulant material adjacent to the nozzle plate/substrate assembly and substrate support; and curing the nozzle plate adhesive, the substrate adhesive, and the encapsulant material, wherein at least the substrate adhesive and the encapsulant material are substantially flexible after curing.

7. The method of claim 6, wherein each of the substrate adhesive and the encapsulant material, after curing, have a Young's modulus of less than about 2000 MPa, a shear modulus at 25° C. of less than about 15 MPa, and a glass transition temperature of less than about 90° C.

8. The method of claim 6, wherein the nozzle plate adhesive has a Young's modulus of less than about 2000 MPa, a shear modulus at 25° C. of less than about 15 MPa, and a glass transition temperature of less than about 90° C.

9. The method of claim 6, wherein the encapsulant material comprises first side and second side encapsulant materials adjacent to the electrical connections, further comprising, at least partially co-curing the first side and second side encapsulating materials.

10. The method of claim 6, wherein each of the substrate adhesive, the nozzle plate adhesive, and the encapsulant material, after curing, have a Young's modulus of no more than about 1500 MPa, a shear modulus at 25° C. of no more than about 10 MPa, and a glass transition temperature of no higher than about 60° C.

11. The method of claim 6, wherein the substrate adhesive, the nozzle plate adhesive, and the encapsulant material respectively comprise a thermally curable substrate adhesive, a thermally curable nozzle plate adhesive, and at least one of a thermally curable encapsulant material and an ultraviolet (UV) curable encapsulant material.

12. A method for improving micro-fluid ejection head durability, comprising:

adhesively bonding a nozzle plate adjacent to a substrate with a nozzle plate adhesive to provide a nozzle plate/substrate assembly;

adhesively bonding the nozzle plate/substrate assembly in a pocket of a substrate support using a substrate adhesive;

encapsulating electrical connections to the nozzle plate/substrate assembly with an encapsulant material adjacent to the nozzle plate/substrate assembly and substrate support structure; and curing the nozzle plate adhesive, the substrate adhesive, and the encapsulant material, wherein the nozzle plate adhesive, the substrate adhesive, and the encapsulant material are substantially flexible after curing, and the micro-fluid ejection head has a greater drop height than an ejection head made in the absence of substantially flexible encapsulant material and substantially flexible adhesives.

13. The method of claim 12, wherein each of the substrate adhesives the nozzle plate adhesive, and the encapsulant material, after curing, have a Young's modulus of less than about 2000 MPa, a shear modulus at 25° C. of less than about 15 MPa, and a glass transition temperature of less than about 90° C.

14. The method of claim 12, wherein the encapsulant material comprises first side and second side encapsulant materials adjacent to the electrical connections, further comprising, at least partially co-curing the first side and second side encapsulating materials.

15. The method of claim 12, wherein each of the substrate adhesive, the nozzle plate adhesive, and the encapsulant material, after curing, have a Young's modulus of no more than about 1500 MPa, a shear modulus at 25° C. of no more than about 10 MPa, and a glass transition temperature of no higher than about 60° C.

16. The method of claim 12, wherein the substrate adhesive, the nozzle plate adhesive, and the encapsulant material are each at least one of thermally curable adhesive and ultraviolet (UV) curable adhesive.

17. A micro-fluid ejection device comprising a micro-fluid ejection head made by the method of claim 12.

* * * * *